United States Patent [19]

Sunesson

[11] 4,398,321

[45] Aug. 16, 1983

[54] LASHING SLING FASTENING BUCKLE

[75] Inventor: Bengt S. Sunesson, Angered, Sweden

[73] Assignee: Lyft-och Surrningsredskap AB, Kungalv, Sweden

[21] Appl. No.: 268,682

[22] Filed: Jun. 1, 1981

[30] Foreign Application Priority Data

Jun. 2, 1980 [SE] Sweden ..... 8004099

[51] Int. Cl.[3] ..... A44B 11/10

[52] U.S. Cl. ..... 24/196

[58] Field of Search ..... 24/196

[56] References Cited

U.S. PATENT DOCUMENTS 495,633 4/1893 Hoyt ..... 24/196

*Primary Examiner*—Robert Peshock

*Attorney, Agent, or Firm*—Harness, Dickey & Pierce

[57] ABSTRACT

A sling fastening buckle comprising a buckle frame in the form of a bottom plate in which is formed an aperture, the marginal portions of said plate being angularly bent to form two channels, in which two bars are displaceable. The bars have an essentially oblong cross-sectional shape with rounded edges. A sling is placed about a load so as to encircle the latter while the two end parts of the sling are passed through the aperture, between the bars and arranged around the associated bar. The end parts of the sling are then passed between the bars and the edge limiting the aperture. After tightening the sling about the load, the bars are forced outwards towards the edges of the aperture, thus applying a clamping action on the sling which is thus locked in position.

The locking ceases when a pulling force is applied on the end parts of the sling and the sling may then be further tightened. The sling is released by positioning the buckle frame at an angle relative to the support.

6 Claims, 8 Drawing Figures

Fig. 2
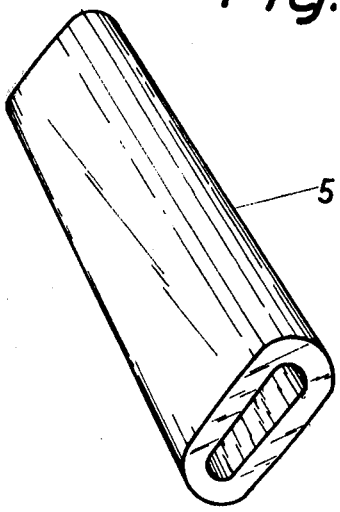
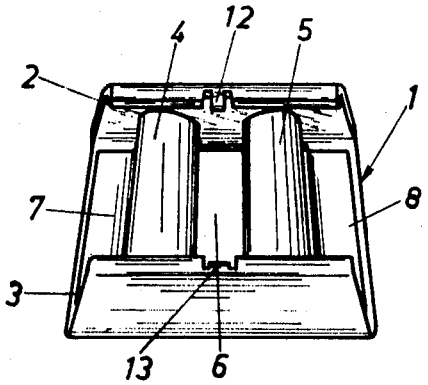
Fig. 1

LASHING SLING FASTENING BUCKLE

BACKGROUND OF THE INVENTION

The invention concerns a buckle for fastening slings and similar lashing-down straps.

When loads are lashed down with the aid of slings or similar lashing-down straps the sling is applied around the load and secured with the aid of a fastening buckle or the like. The function of the buckle is to tie together the two sling ends in a manner ensuring that the load is safely secured while at the same time allowing release of the sling. In addition, it should be possible to tighten the sling further in a convenient and quick manner.

Prior-art buckles have failed to meet these three requirements simultaneously. One prior-art buckle consists of a plate in the shape of a frame and two bars. One end of each bar is attached to the plate in such a manner that the bars may be turned down against the plate. When in this position against the plate, the bars may be displaced somewhat in the plane defined by the plate. When the two sling ends are applied around the bars and tightened, the bars are turned down with their ends abutting against the plate. The sling is applied around the load and carried through the aperture in the plate. When the sling is tightened, the bars are urged apart, locking the sling in position. However, this buckle construction does not easily allow the sling to be further tightened around the load. Because of the design of the buckle it is impossible to tighten the sling further by pulling either of the two end parts of the sling. This is so because the locking effect of the buckle does not cease when a pulling force is exerted on the end parts of the sling.

The same problem is met in a buckle device disclosed in SE No. 312 990 or U.S. Pat. No. 3,414,947. The buckle shown in these specifications secures the sling in position but does not automatically release the sling when a pulling force is exerted on one of the sling end parts.

When belt tightening devices are used, it is desirable to be able to lash down the load with the aid of the tightening device and then to be able to remove it without lessening the tautness of the sling around the load. Furthermore, it is desirable to be able to tighten the sling further about the load without having to remove the buckle.

SUMMARY OF THE INVENTION

The subject invention concerns a lashing-sling fastening buckle in which are met all three requirements outlined above, viz. locking of the sling when the latter is lashed down about the load, easy removal of the buckle, and finally, possibility of further tightening of the sling, once it has been applied about the load.

This is achieved in accordance with the present invention in a buckle comprising a buckle frame including a bottom plate, in which two opposite marginal portions are angularly bent to form channels and the bottom piece of said plate which extends between the marginal portions is formed with an aperture. The invention is characterised in that the buckle comprises two bars, the end sections of which are displaceable in said channels in such a way that the bars may be displaced independently of one another to an end position adjacent their respective edge of the aperture, through which aperture are intended to be passed the ends of a lashing-down sling to be clamped in position by said bars, that a part of that side of each bar that faces the frame bottom plate has a round configuration whereas an adjoining part of that bar side is essentially flat, said flat part being at an angle to the frame bottom plate in the sling locking position, that the planes thus defined by the essentially flat sides of the two bars in the sling locking position form an angle $\alpha$ relative to one another, the apex of which points into the aperture, and that the end sections of the bars are formed with two stop faces arranged to limit the turning movements effected by the bars upon application of a pulling force on either end part of the sling that is passed about the bars.

Further characteristics of the invention will appear from the dependent claims.

BRIEF DESCRIPTION OF THE DRAWINGS

The invention will be described in closer detail in the following with reference to the accompanying drawings, wherein FIG. 1 is a perspective view of the lashing-sling fastening buckle in accordance with the invention, FIG. 2 is a perspective view of one of the bars of the buckle.

DETAILED DESCRIPTION OF A PREFERRED EMBODIMENT

Figure 3:
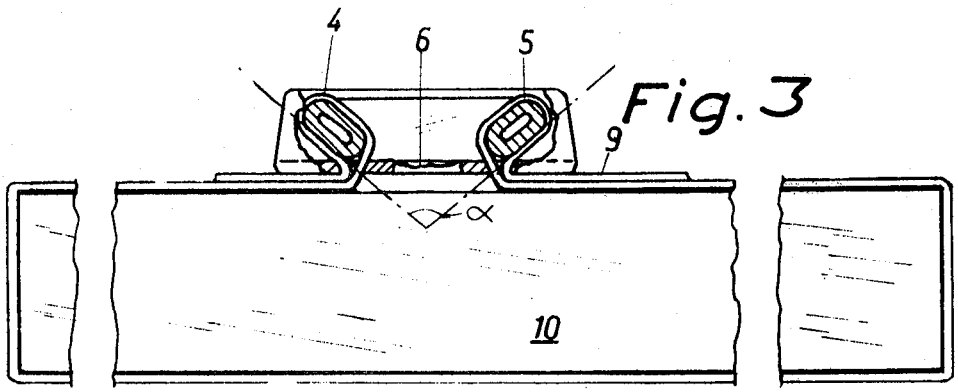
FIG. 3 is a partly broken lateral view of a fastening buckle in accordance with the invention, showing the position in which the buckle locks a sling that is tightened about a load.

FIG. 1 shows a lashing-sling fastening buckle in accordance with the invention in a lateral view. Two marginal portions of the buckle frame 1 are bent angularly upwards so as to form two channels 2, 3. In these channels 2, 3 are positioned the end sections of two bars 4, 5. The bars 4, 5 are arranged to be displaced in the channels 2, 3 across an aperture 6 formed in the bottom plate of the buckle frame 1. To limit the movements of the bars 4, 5 inside the channels 2, 3 two removable members 7, 8 are placed along the edges in the buckle frame bottom plate, which edges delimit the aperture 6 in the directions of displacement of the bars 4, 5. The buckle frame is formed with shoulders 11 (see FIGS. 7 and 8) matching recesses formed in members 7, 8 and consequently retaining the latter in position. The bars 4, 5 are so shaped that in cross-section their middle section has an essentially oblong or flattened oval configuration with rounded corners. The upper limiting edges of the channels 2, 3 are provided with pin-like projections 12, 13. These projections serve to delimit the maximum possible oblique position of the bars.

The design of the bars appears from FIG. 2. In the embodiment shown the bar is made from a tube of a circular cross-sectional shape which is somewhat flattened into the desired oblong or oval shape. The end sections, that is the parts of the bars projecting into the channels 2, 3 have a shape that is identical with that of the remainder of the bars. Alternatively, the bar end sections could have a shape deviating from that of the middle section of the bar. It is essential, however, that the end sections are capable of serving to stop movement of the bars in the two end positions thereof, viz. the locking and non-locking positions, as will to be described in the following.

FIG. 3 illustrates the manner in which a lashing-sling 9 is passed about a load 10 and tightened about the latter with the aid of the fastening buckle 1 in accordance with the invention. The two ends of the sling are passed through the aperture 6 in the buckle frame and between the bars 4, 5. Each end is then passed around the associated bar and again through the aperture 6. Consequently, the short ends of the sling will be positioned intermediate the sling and the edges delimiting the aperture in the bottom plate of the buckle frame in the directions of displacement of the bars. When a pulling force is applied to the part of the sling that is applied about a load (that is, when the sling is tightened about a load), the bars 4, 5 will be forced outwards against the edges of the buckle and clamp the sling in position, preventing it from sliding. The sling 9 thus is clamped between the bars and the edges delimiting the aperture 6. The locking effect is such that the harder the sling is tightened about the load, the harder will be the clamping effect on the sling in the buckle. On the other hand, when a pulling force is exerted on any one of the short ends of the sling the clamping effect on the sling automatically ceases and the sling may be further tightened. This appears most clearly from FIGS. 7 and 8.

Figure 4:
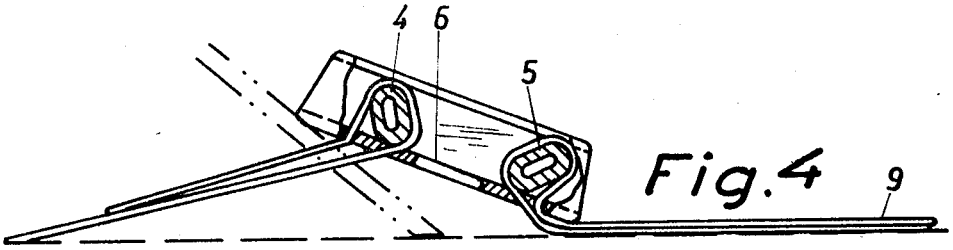
FIG. 4 is a partly broken lateral view of the fastening buckle in accordance with the invention in an oblique position to release the sling.

FIG. 4 illustrates removal of the sling from the fastening buckle. The buckle is positioned at an angle relative to the supporting face (in the case illustrated the load) by insertion of an object underneath the buckle, forcing one of the buckle edges upwards. The pulling force exerted by the sling will then no longer urge the bar at the end of the buckle being lifted against the edge of the aperture and consequently the clamping effect on the sling ceases. The sling is then easily removed.

Figure 5:
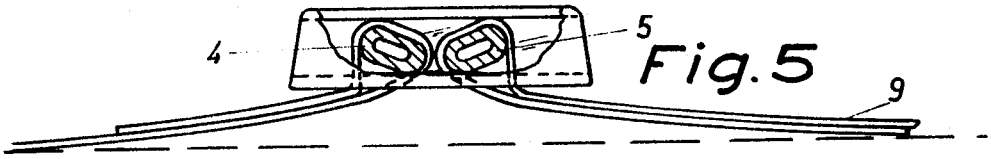
FIG. 5 is a partly broken lateral view of the fastening buckle in a non-locking position.

FIG. 5 illustrates the fastening buckle in its non-locking position. In this position, the bars 4, 5 have not yet been forced outwards into engagement with the edges of the aperture 6 and therefore do not exert a clamping action on the sling 9. When a pulling force is applied on any one of the short ends of the sling the latter is tightened about the load. The construction of the bars is such that as long as the pulling force acting on either end part of the sling exceeds the tensile force in the part of the sling encircling the load, the bars will not prevent further tightening of the sling about the load. When the pulling force on any one of the end parts of the sling is lessened, the bar associated with that sling end part will be urged by the tensile force in the sling outwards to its end position in which the sling is clamped and locked in position. The bars 4, 5 are displaceable independently of one another, which means that the tightening effect may be exerted by means of one bar only, since in the meantime the other bar will assume a position in which is locked the part of the sling that encircles the opposite bar.

Figure 6:
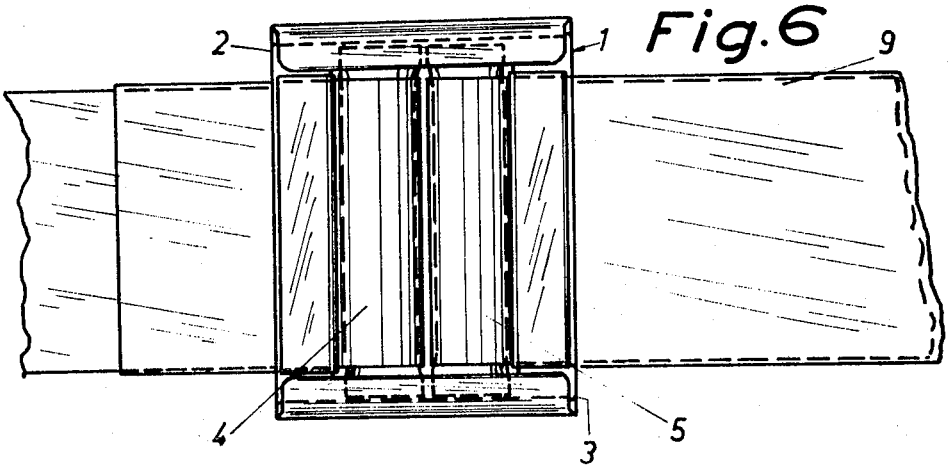
FIG. 6 is a view from above of the fastening buckle, showing the latter in the same non-locking position as illustrated in FIG. 5, FIGS. 7 and 8 are cross-sectional views through one of the bars of the fastening buckle and illustrating the manner in which the locking effect of the buckle on the sling automatically ceases when a pulling force is applied on one end of the sling.

FIG. 6 shows the fastening buckle in accordance with the invention in a view from above with the bars 4, 5 assuming the same position as in FIG. 5. This figure shows clearly the manner in which the end parts of the sling are positioned above the part of the sling encircling the load. One of the parts of the sling positioned outside the fastening buckle is considerably shorter than the other part. This is convenient, since this makes it easier to attach a sling tightening device to the sling and use the latter to tighten the sling further about the load. In addition, it becomes easier to remove the sling from the buckle. In the embodiment shown in FIG. 6 the fastening buckle 1 is not provided with projections 12, 13 which limit the movability of the bars. Such projections are preferred but not essential to the function of the fastening buckle.

Figure 7:
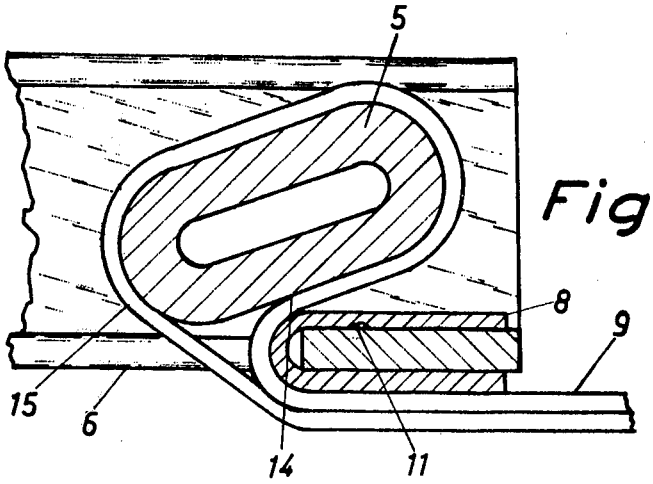
Figure 8:
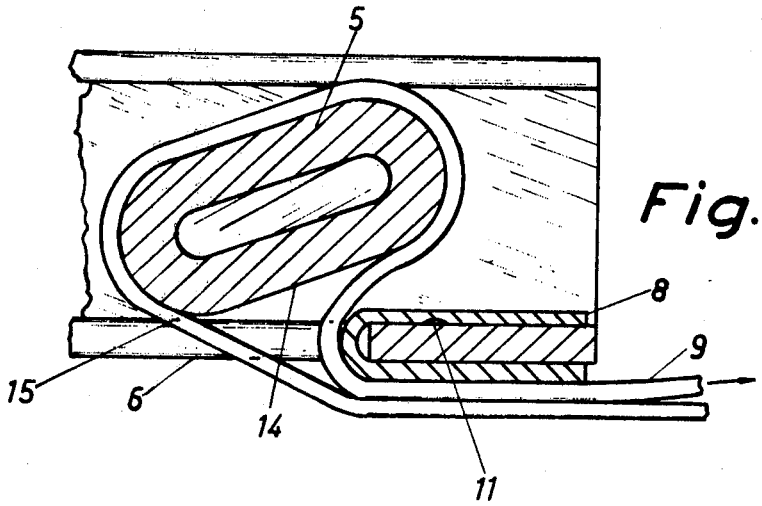

FIGS. 7 and 8 illustrate what happens when the locking effect (clamping) on the sling ceases upon application of a pulling force on the end part of the sling, that is the free end of the sling. FIG. 7 shows one of the bars in the position in which the sling is clamped and locked. The tensile force in the part of the sling encircling the load urges the bar against the outer edge of the aperture 6 on account of the friction between the string and the bar. Consequently, the bar is urged outwards and, as appears from FIG. 7, the result is that the sling will be clamped between the bar 5 and member 8. In addition, the tensile force has the effect of tending to turn the bar counter-clockwise as seen in FIGS. 7 and 8. The turning movement of the bar is prevented, however, by the provision on the bar end of a stopper face, that is, the rounded corners, which abut against the edges of the channels 2, 3. The sling thus is in locked position and increased tensile force in the part of the sling encircling the load will only result in an increase of the force locking the sling. This drawing figure also shows the manner of attachment of the member 8 on the bottom plate of the buckle frame by means of a recess in member 8 which corresponds to a projection 11 on the buckle frame bottom plate.

FIG. 8 illustrates the situation when the clamping effect on the sling ceases as a result of application of a pulling force on the end part of the sling. As long as the tensile force in the sling encircling the load, that is the force with which the part of the sling encircling the load forces the bar 5 outwards, exceeds the pulling force exerted on the end part of the sling, the bar 5 will continue to exert a clamping force on the sling 9, thus locking the latter in position. When the pulling force on the end part of the sling exceeds the tensile force in the sling encircling the load (even a small difference is sufficient), the bar 5 will be turned clockwise as seen in FIG. 8 and the clamping effect on the sling will cease automatically.

The pulling force on the end part of the sling tends both to urge the bar clockwise as seen in FIG. 8 and to urge it inwards the middle of the aperture 6. As long as the sling is clamped between the bar 5 and the member 8, the bar 5 cannot be displaced towards the centre of the aperture 6, since this would require displacement of the sling 9 relative to the member 8. This relative movement is not possible as long as the sling remains in clamped position. On the other hand, the pulling force exerted on the end part of the sling may bring about turning movement of the bar 5, since this turning movement, as soon as effected, will result in cease of the clamping effect on the sling. Consequently, the cease of the clamping effect on the sling 9 is brought about by the turning movement of the bar 5 and not by the displacement of the bar 5 towards the centre of the aperture 6 that will occur when the clamping of the sling ceases. The end sections of the bars are designed so as to effect combined turning and displacement movements. In order to ensure that turning movement of the bar 5 will result in cease of the clamping effect on the sling it is necessary that the cross-sectional configuration of the bar 5 is such that it comprises one part 14, about which the sling is passed and which is non-round, preferaably flat, and an adjoining part 15 which is essentially round. The important thing is that the cross-section of the bar along part 14 is not round with a radius coinciding with the radius of portion 15. Otherwise, the design of the bar is of less importance but from a manufacturing point of view it is preferable that the bar is symmetrical in shape and essentially oblong or oval with rounded short sides. Bars having a circular cross-sectional shape would not be able to bring about automatic cease of the described clamping effect resulting from locking.

The end sections of the bars 5 are formed with stop faces which preferably coincide with the rounded edges of the middle section of the bars but which could be shaped differently. The purpose of such faces is to prevent clockwise turning movement of the bar as seen in the drawings in a position in which clamping of the sling ceases as a result of application of a pulling force on the end parts of the sling.

FIG. 8 shows the bar 5 in a different position in which the sling is no longer clamped. In this position the bar 5 may be pressed backwards by the pulling force acting on the end part of the sling. Upon continued application of a pulling force on the end part of the sling, the sling will be tightened harder about the load. When the pulling force on the end part of the sling is weaker than the force with which the sling is tightened about the load, the sling will automatically be forced to the position at the edge of the aperture 6 in which the sling is locked. Also here the end sections of the bars are formed with stop faces which preferably coincide with the rounded edges and which prevent clockwise turning movement of the bars. Between the stop faces of the bar end sections the bars could have a continuously domed shaped in order to ensure even and continuous movement of the bars between the two end positions of the latter, viz. locking and non-locking positions.

The locking of the sling is automatically released when it is desired to tighten the sling further, which thus becomes possible without it being necessary to remove the fastening buckle, and likewise the locking effect automatically becomes operative when the tightening of the sling about the load is completed and the pulling force on the end part of the sling ceases. In addition, the buckle is easily removed, since all that is needed to do this is to put it at an angle to the supporting face and pull on the part of the sling encircling the load.

It should be apparent from the aforegoing that all the requirements and purposes outlined initially are fully met with the aid of the construction of the buckle in accordance with the invention that is simple, reliable and non-expensive.

The embodiments described above is to be regarded as an example only and a number of modifications are possible within the scope of the appended claims. For example, the upper faces of the bars 5, 6 may be cambered or domed.

What I claim is:

1. An improved fastening buckle for slings and similar lashing-down straps, comprising a buckle frame, said buckle frame including a bottom plate, two opposite marginal portions of said bottom plate being angularly bent to form channels, an aperture formed in said bottom plate, said aperture extending between said marginal portions, the improvement comprising two bars, end sections on said bars, said end sections displaceable in said channels independently of one another to their respective end position adjacent the edges of said aperture, through which aperture are intended to be passed the ends of said sling to be clamped in position by said bars, said bars being rotatable about the respective axes thereof between sling locking and unlocking positions in response to pulling forces exerted on said sling, a side on each one of said bars facing said frame bottom plate, a first part of said bar side having a round configuration, and a second part of said bar side, adjoining said first part, having an essentially flat configuration, said flat part being at an angle to said frame bottom plate in the sling locking position, said essentially flat sides of said two bars defining planes, said planes forming an angle $\alpha$ relative to one another in said sling locking position, the apex of said angle pointing into said aperture, and stop faces on said end sections of said bars, said faces arranged to limit turning movements effected by said bars upon application of a pulling force on either end part of said sling passed about said bars.

2. An improved fastening buckle as claimed in claim 1, wherein removable members are arranged at each one of said edges delimiting said aperture in the direction of movement of said bars, said removable members shaped to exert a clamping effect on said buckle frame edge at said aperture, said members thus limiting bar movement when no sling extends about said bars.

3. An improved fastening buckle as claimed in claim 1, wherein said bars have an essentially oblong cross-sectional configuration with rounded short sides.

4. An improved fastening buckle as claimed in claim 1, wherein said end sections of said bars are extensions of the middle sections of said bars, the cross-sectional configuration of said end sections coinciding with the cross-sectional configuration of said middle sections.

5. An improved fastening buckle as claimed in claim 1, comprising continously cambered surfaces on said bar end sections, said cambered surfaces extending between said stop faces of said end sections, said cambered surfaces allowing continuous transition of said bars from a sling locking position to a sling release position as well as a transition from said sling release position (FIG. 8) to said sling locking position.

6. An improved fastening buckle as claimed in claim 1, comprising projecting pins formed in the upper delimiting part of said buckle channels, said projecting pins extending down into their respective one of said channels.

* * * * *